United States Patent [19]

Burt

[11] Patent Number: 4,473,235

[45] Date of Patent: Sep. 25, 1984

[54] APPARATUS FOR IMPROVED CONTROL OF SKIS

[76] Inventor: Lionel J. Burt, 4144 Crisp Canyon Rd., Sherman Oaks, Calif. 91403

[21] Appl. No.: 340,839

[22] Filed: Jan. 19, 1982

[51] Int. Cl.[3] ..... A63C 9/08

[52] U.S. Cl. ..... 280/11.36; 36/121; 280/617

[58] Field of Search ..... 280/11.36, 611, 618, 280/620, 617; 36/118, 120, 121

[56] References Cited

U.S. PATENT DOCUMENTS

| | | | |
|---|---|---|---|
| 3,747,235 | 7/1973 | Post | 36/2.5 AL |
| 3,945,134 | 3/1976 | Ramer | 36/2.5 AL |
| 4,006,543 | 2/1977 | Post | 36/121 |
| 4,021,053 | 5/1977 | Willi | 280/11.36 |
| 4,058,326 | 11/1977 | Faulin | 280/617 |
| 4,168,085 | 9/1979 | Faulin | 280/618 |
| 4,284,292 | 8/1981 | Faulin | 280/11.36 |
| 4,353,574 | 10/1982 | Faulin | 280/11.36 |

FOREIGN PATENT DOCUMENTS

| | | | |
|---|---|---|---|
| 296843 | 5/1973 | Austria | 280/11.36 |
| 2157724 | 6/1971 | Fed. Rep. of Germany | 280/11.36 |
| 2448361 | 9/1980 | France | 280/11.36 |
| 2457110 | 12/1980 | France | 280/11.36 |
| 102310 | 4/1922 | Switzerland | 280/11.36 |
| 922086 | 3/1963 | United Kingdom | 280/11.36 |

*Primary Examiner*—Joseph F. Peters, Jr.

*Assistant Examiner*—Michael Mar

*Attorney, Agent, or Firm*—Fulwider, Patton, Rieber, Lee & Utecht

[57] ABSTRACT

Apparatus is provided for improving control of snow skis while reducing likelihood of injury and permitting use of relatively flexible and comfortable ski boots. The apparatus comprises a leg support assembly extending upwardly from the laterally outside edge of the ski for connection by use of a wraparound cuff to the skier's leg at a position slightly below the knee. The leg support assembly is adjustable to permit a selected degree of unrestrained flexion of the leg, including the knee and the ankle, in a longitudinal direction with respect to the ski for enhanced ski control and reduced muscular fatigue. However, the leg support assembly is laterally rigid to transmit lateral movements of the leg directly to the outside edge of the ski for improved edging during turns, while the cuff helps to prevent inward twisting of the knee during edging to reduce likelihood of injury. In one embodiment, the apparatus further includes a bidirectional binding assembly incorporated into the leg support assembly for use in lieu of a conventional boot binding mounted on the ski. In another embodiment, an adjustable cable is connected between the cuff and the front tip of the ski for use in obtaining a reverse camber condition of the ski upon rearward flexion of the leg for lifting the front tip of the ski, particularly during turns in deep powder.

36 Claims, 17 Drawing Figures

FIG. 5
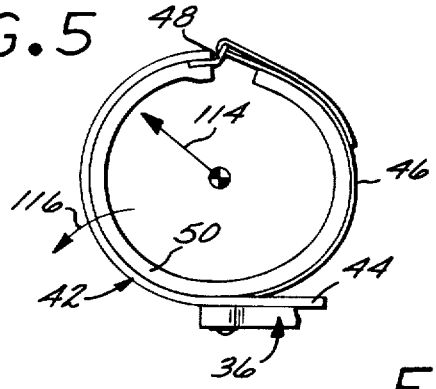
FIG. 6
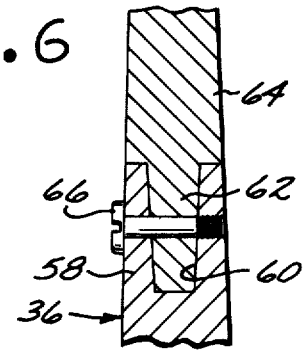
FIG. 7
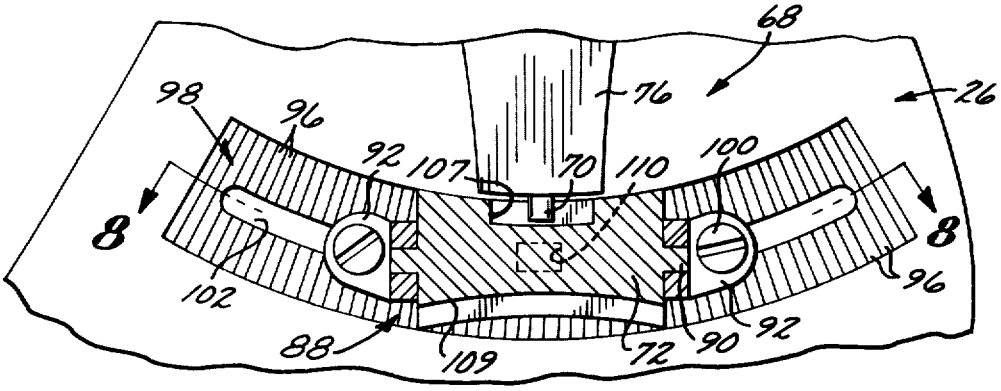
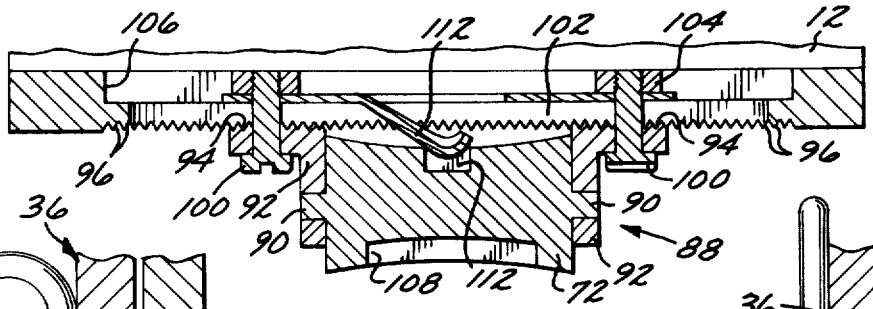
FIG. 8
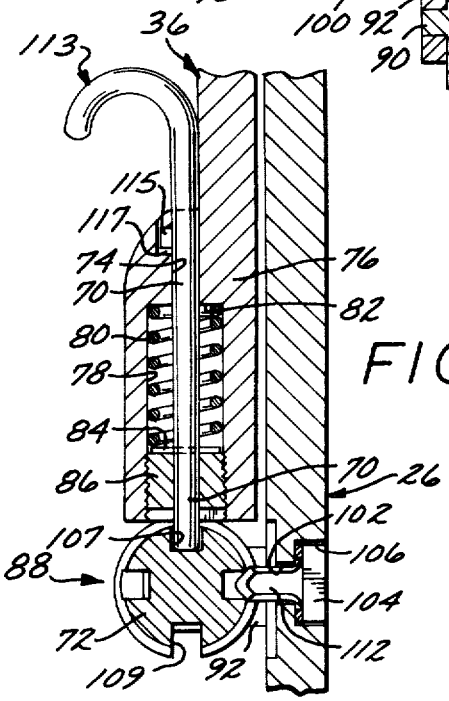
FIG. 9
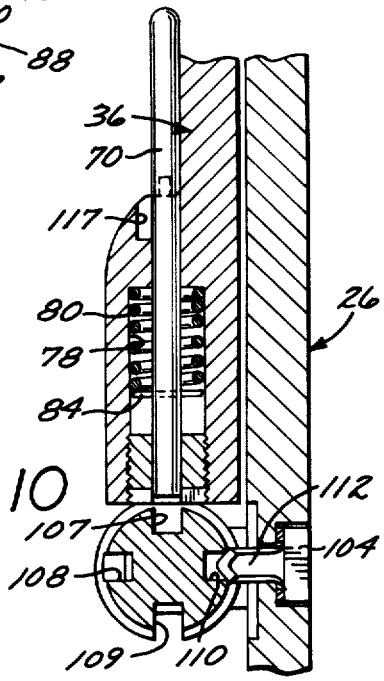
FIG. 10

APPARATUS FOR IMPROVED CONTROL OF SKIS

BACKGROUND OF THE INVENTION

This invention relates generally to apparatus and devices for enhancing control over snow skis in response to leg movements of the skier. More specificallly, this invention relates to an apparatus for obtaining improved ski control in response to natural unrestrained leg motions thereby increasing skier comfort and reducing likelihood of injury.

In the sport of snow skiing, considerable attention has been focused on improvements to skiing equipment which will provide enhanced control of the skis throughout a variety of traditional skiing movements. In this regard, modern ski boots have been developed to have a rigid shell construction for tightly encasing and substantially immobilizing the foot and ankle. The rigid ski boots thus prevent foot and ankle flexions which can otherwise attenuate the transfer of motion from the leg to the ski and thereby require accentuated leg motions to provide the desired skiing movements. While these modern rigid ski boots perform their intended function, they are accompanied by a significant number of major drawbacks. For example, rigid ski boots are particularly uncomfortable when walking or when standing upright on the skis. Moreover, rigid ski boots are tight fitting and thereby interfere with normal foot and leg circulation resulting in coldness of the feet and excessive muscular fatigue. These conditions reduce the sensitivity of the foot to skiing movements to thus increase the likelihood of injury. Furthermore, since the right boot locks the foot and ankle in place, the foot and ankle are precluded from absorbing and dissipating shock forces commonly encountered while skiing. Instead, the shock forces are transferred upwardly to the knee joint where they can result in injuries of a particularly severe and permanent nature.

In recognition of the problems attendant with rigid ski boots, a variety of devices and apparatus have been proposed for transferring leg movements to the ski through a force structure which bypasses the foot and ankle and thereby avoids any requirement to immobilize the foot and ankle. See, for example, U.S. Pat. Nos. 4,006,543; 3,747,235; 3,945,134; 4,021,053; 4,058,326; and 4,168,085, all of which depict brace-type structures connected between the leg and the ski for transmitting twisting motion directly from the leg to the ski. However, in these devices, rotation of the knee for turning purposes is both permitted and encouraged, in spite of the fact that this rotation is known to expose the knee to relatively severe injury. Moreover, in some of these devices, additional structures are provided to lock the leg in a fixed position of flexion to thereby indirectly lock the foot and ankle without requiring a rigid ski boot. However, locking of the leg is no more successful in preventing injuries than is the use of rigid boots, particularly when at least some unrestrained longitudinal leg flexion is desired for optimum comfort and ski control.

The present invention overcomes the problems and disadvantages of the prior art by providing apparatus for transferring lateral leg motions directly to the ski while permitting a selected and adjustable degree of unrestrained leg flexion in the longitudinal direction and while substantially resisting rotation of the knee during a turning movement.

SUMMARY OF THE INVENTION

In accordance with the invention, apparatus is provided for improved control of snow skis throughout the various skiing movements with increased safety and with substantially increased skier comfort. The apparatus comprises a leg support assembly connected between the laterally outside edge of the ski and the skier's leg for transferring lateral turning forces directly from the leg to the edge of the ski without requiring transmission of those forces through the foot and ankle. However, the leg support assembly advantageously permits a selected degree of unrestrained leg flexion in the longitudinal direction for enhanced ski control and reduced muscular fatigue. Moreover, the apparatus includes means for restraining the knee against twisting motion particularly during turning movements to reduce exposure of the knee to potential injury.

In accordance with a preferred form of the invention, the leg support assembly comprises a lower support member extending upwardly from the laterally outside edge of the ski and pivotally connected to an upper support member on a transverse axis positioned generally in alignment with the skier's ankle. The upper support member projects from the pivot axis upwardly for connection by a wraparound cuff to the skier's leg at a position slightly below the knee. An adjustment assembly is connected between the upper and lower support member to select the relative angular position of the upper support member with respect to the lower support member and to select the desired magnitude of rotational freedom between the two support members.

During skiing, the adjustment assembly permits a selected magnitude of rotational movement between the upper and lower support members to permit a corresponding degree of unrestrained leg flexion in the longitudinal direction for maximum skier comfort and ski control. However, the two support members are laterally rigid to transmit lateral movements of the leg in the region of the knee directly to the laterally outside edge of the ski. In this manner, leg movements for edging the skis during turning maneuvers result in forces transmitted directly to the ski in bypass relation to the foot and ankle, thereby permitting the skier to wear comfortable flexible boots which allow flexion of the foot and ankle to absorb shock forces. Importantly, during such turning maneuvers, the cuff cooperates with the upper support member to resist inward rotation of the knee thereby further reducing likelihood of injury.

In a preferred form, the adjustment assembly comprises a rotatable tumbler mounted at a selected position along the length of an adjustment slot in the lower support member. The tumbler includes a plurality of longitudinally extending channels of different lengths wherein the tumbler is rotatable to orient a select one of the channels in a direction for reception of a spring-loaded locking pin mounted on the upper support member. Thus, the relative angular relationship between the two support members is selected by positioning the tumbler along the adjustment slot, and the permitted degree of rotational freedom of the upper support member is selected by tumbler rotation to align a selected channel with the locking pin.

In one alternative embodiment, a spring-loaded release binding is incorporated into the leg support assembly to eliminate the requirement for a conventional boot binding on the ski. In this embodiment, the upper support member is provided in the form of a first section pivoted to the lower support member and a second sections coupled to the cuff, wherein both sections telescopically interfit with an intermediate third section. The third section is releasably secured to the first and second section by a pair of spring-loaded release assemblies which are preferably responsive to forces acting in different directions to permit separation of the upper support member when an applied force exceeds a predetermined magnitude.

According to a further alternative embodiment of the invention, apparatus is provided for selectively reversing the normal camber of the ski and thereby lifting the front tip of the ski for enhanced control during turning movements, particularly when skiing in powder. This apparatus comprises a cable housing mounted on the cuff and carrying a cable adapted to be drawn therefrom a sufficient distance for relatively taut connection between the cuff and the front tip of the ski. The withdrawn length of the cable is fixed by a lock, whereupon a reverse ski camber is obtained when the skier flexes his legs toward a more erect position within the degree of freedom permitted by the adjustment assembly. This results in a rearward and upward pulling on the cable to pull upwardly on the front tip of the ski to move the ski to a reverse camber configuration.

Other features and advantages of the present invention will become more apparent; from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 5 is a top plan view of the ski control apparatus taken generally on the line 5—5 of FIG. 2;

FIG. 6 is an enlarged fragmented vertical section of the ski control apparatus taken generally on the line 6—6 of FIG. 2;

FIG. 7 is an enlarged fragmented side elevation view of the ski control apparatus, partially in vertical section, taken generally on the line 7—7 of FIG. 3;

FIG. 8 is a fragmented sectional view of the ski control apparatus taken generally on the line 8—8 of FIG. 2;

FIG. 9 is an enlarged fragmented vertical section of the ski control apparatus taken generally on the line 9—9 of FIG. 2;

FIG. 10 is an enlarged fragmented vertical section generally similar to FIG. 9 and showing the apparatus in an alternative position of adjustment;

DETAILED DESCRIPTION OF THE PREFERRED EMBODIMENTS

Figure 1:
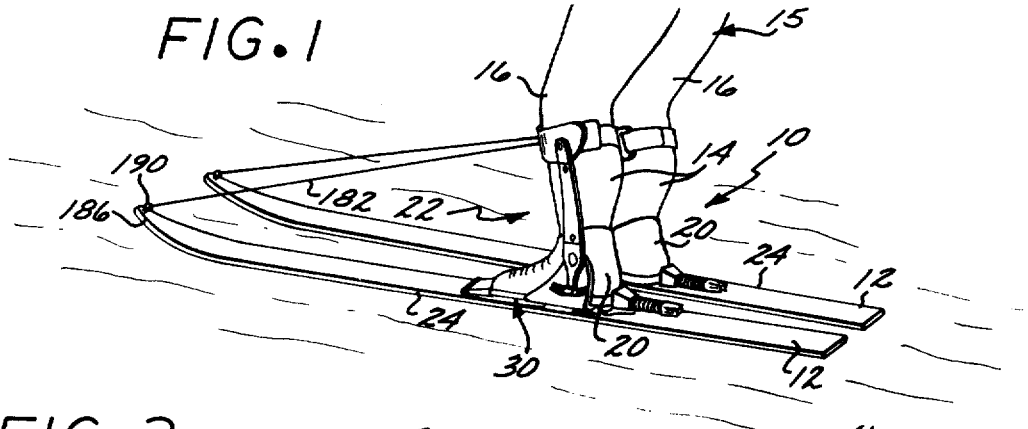
FIG. 1 is a perspective view illustrating use of the apparatus for improved ski control embodying the novel features of the invention.

As shown in the exemplary drawings, apparatus for improving control of snow skis is designated generally by the reference numeral 10. The apparatus is illustrated in use in FIG. 1 installed upon a pair of snow skis 12 and coupled between the skis 12 and the legs 14 of a skier 15 at a location slightly below the skier's knees 16. In use, the apparatus 10 permits enhanced control of the skis 12 particularly during turning maneuvers by transmitting lateral forces directly from the legs 14 to the laterally outside edges of the skis 12 while permitting a selected range of unrestrained leg flexion in the longitudinal direction for further improved ski control, comfort, and safety. In addition, the apparatus resists inward rotation or twisting of the skier's knees 16 to reduce further the likelihood of injury.

The apparatus 10 of this invention permits substantially improved control over the movements of the skis 12 during normal skiing maneuvers. The apparatus 10 advantageously provides this enhanced ski control by use of normal skiing techniques without repairing the skier to learn additional or new skiing motions. Importantly, the apparatus 10 permits turning forces to be applied to the skis without requiring those forces to be transferred through the skier's foot and ankle regions, thereby avoiding the need for conventional ski boots which rigidly encase the foot and ankle. Instead, the skier 15 may wear relatively soft and flexible ski boots 20 to increase greatly skier comfort with significantly reduced muscular fatigue and a correspondingly reduced likelihood of injury. Moreover, the wearing of flexible ski boots 20 permits natural flexion of the foot and ankle for absorption and dissipation of shock forces which would otherwise be transferred to the knees 16 to expose the knees to potential major injury. However, the apparatus 10 does not sacrifice control over the skis, but instead provides for enhanced ski control while at the same time permitting a range of natural leg flexion for further improved skier comfort.

As illustrated in the accompanying drawings, the preferred apparatus 10 of this invention is provided in the form of an adjustable leg support assembly 22 on each ski 12 wherein the leg support assembly extends upwardly along the laterally outside face of the associated leg 14 for transferring lateral forces from the leg 14 directly to the laterally outside edge 24 of the ski. More particularly, as shown in FIGS. 1-4, the leg support assembly 22 comprises a lower support member 26 connected to the ski 12 in a suitable manner, such as by use of an integral sole plate 28 adapted for connection to a conventional boot binding assembly 30 mounted directly on the ski. From the sole plate 28, the lower support member 26 includes a rigid upright 32 extending upwardly alongside the laterally outside face of the skier's foot and ankle for connection by a transversely extending pivot pin 34 to the lower end of an upper support member 36. This pivot pin 34 is oriented to permit pivoting movement between the lower and upper support members 26 and 36 about a transverse axis 37 generally coincident with the skier's ankle. However, the pivot pin 34 prevents substantial lateral relative movement between the two support members, and in this regard, the pivot pin 34 desirably has a relatively large diameter, as shown, to withstand the substantial forces which can be applied thereto during skiing maneuvers.

The upper support member 36 extends upwardly from the pivot pin 34 for connection by a screw 40 or the like to a wraparound cuff 42. This cuff includes a relatively rigid and generally semicircular shield 44 shaped to extend from the connecting screw around the front of the skier's leg to a position at the laterally inside face of the leg. This shield 44 is secured snugly about the skier's leg by use of a connecting strap 46, such as the Velcro-type strap illustrated best in FIG. 3, connected to one end of the shield and then folded back upon itself subsequent to reception through a buckle 48 at the other end of the shield. Conveniently, a strip 50 of foamed cushion material or the like provides the cuff with a soft and comfortable interior lining, and a longitudinal elongated slot 52 is formed in the rigid shield 44 for allowing longitudinal adjustment of the cuff with respect to the leg support assembly 22 in accordance with the comfort requirements of the individual skier.

The vertical height of the upper support member 36 is advantageously selected in accordance with the height of the individual skier for connection of the wraparound cuff 42 to the skier's leg at a position slightly below the skier's knee. This vertical height adjustment is obtained, in accordance with the preferred embodiment, by dividing the upper support member 36 into a lower section 54 pivotally connected to the pivot pin 34 and having an upwardly projecting tab 56 for sliding reception into a mating recess 57 at the lower end of an intermediate section 58. The intermediate section 58 in turn projects upwardly and terminates in an upwardly open recess 60, as viewed in FIG. 6, for mating reception of a tab 62 formed in an upper section 64 which is in turn secured to the cuff 42 by the screw 40. By appropriate selection of one of a plurality of interchangeable intermediate sections 58 of different lengths, the overall vertical height of the upper support member 36 can be selected in accordance with the height of the individual skier. If desired, once the lower and upper sections 54 and 64 are interfitted with the intermediate section 58 of desired length, set screws 66 or the like can be provided to prevent separation of the various sections during use. Alternatively, other modified upper support member constructions may be used to accommodate height adjustments, such as, for example, the use of telescopically interfitting sections.

The adjustable leg support assembly 22 thus provides a mechanical coupling between the skier's leg 14 at a position adjacent the knee 16 directly to the ski 12, and in particular, directly to the laterally outside edge 24 of the ski. Since this mechanical coupling is substantially rigid in response to application of laterally directed forces, lateral movements of the leg are transferred directly to the ski without requiring transmission of those forces through the skier's ankle and foot. Accordingly, lateral movements of the leg during a turning maneuver are transmitted directly to the ski for substantially enhanced ski response and control. The lateral movements thus bypass the foot and ankle to avoid any need to encase the foot and ankle in conventionally rigid ski boots. Instead, the skier is permitted to wear the flexible boots 20 (FIG. 1) which are comfortable throughout the various skiing and walking motions and which allow the foot and ankle to flex naturally for absorption of shock forces encountered while skiing.

The laterally rigid support assembly 22 is adjustable to select the angular relationship between the upper and lower support members 36 and 26 in accordance with the desired skiing stance of the particular skier. More specifically, the upper support member 36 is mounted with respect to the lower support member 26 by the pivot pin 34 which permits pivoting motion of the upper support member 36 forwardly and rearwardly in the longitudinal direction within a vertical plane generally coincident with the laterally outside edge 24 of the ski. An adjustment assembly 68 is coupled between the two support members 26 and 36 to select the particular angular position of the upper support member 36, typically in a slightly forwardly angled position, as viewed in FIGS. 1 and 2, to accommodate the natural skiing stance of the individual skier. Importantly, however, this adjustment assembly 68 is further adjustable as desired to permit a range of unrestrained pivoting movement of the upper support member 36 in deviation from the normal skiing stance and thereby permit a selected degree of unrestrained leg flexion during skiing. The permission of at least some unrestrained leg flexion has been found to result in further significant improvements in skier control over the skis throughout a wide range of traditional skiing movements, together with a substantial reduction in muscular fatigue while skiing which is accompanied by enhanced skier comfort with reduced likelihood of injury.

The adjustment assembly 68 is shown in detail according to a preferred form in FIGS. 7-10 to include a locking pin 70 carried by the upper support member 36 for selective and releasable reception into a channeled tumbler 72 carried by the lower support member 26. More particularly, the locking pin 70 is received downwardly through an open bore 74 formed in an extension section 76 of the upper support member 36 which has an enlarged thickness and projects downwardly from the pivot pin 34. This bore 74, as shown in FIGS. 9 and 10, opens into a radially enlarged cylindrical chamber 78 sized to accommodate a compression spring 80 reacting between an axial shoulder 82 at the top of the chamber and a washer 84 fixed to the pin 70. The compression spring 80 urges the washer 84 downwardly into normal bearing engagement with a plug 86 threaded into the lower end of the chamber, wherein the pin 70 projects downwardly through the plug 86 toward engagement with the channeled tumbler 72.

The channeled tumbler 72 is part of a tumbler assembly 88 adapted for adjustable mounting with respect to the lower support member 26. The tumbler comprises a generally cylindrical member supported for rotation about its own axis in a generally horizontal position by a pair of stub shafts 90 at its opposite ends carried respectively by a pair of L-shaped brackets 92. These brackets, as shown in FIG. 8, include serrated back surfaces 94 for meshing engagement with generally vertically oriented teeth 96 of an arcuate mounting track 98 formed on the laterally outside face of the lower support member. The tumbler assembly is secured to the track 98 at a selected position along the track length by a pair of fastening screws 100 extending through the brackets and an arcuate adjustment slot 102 formed in the track 98 for threaded reception into nuts 104. Conveniently, these nuts 104 are countersunk into an enlarged groove 106 such that the nuts are substantially flush with the lower support member and are prevented from rotating when the screws 100 are tightened.

The mounting track 98 and the associated adjustment slot 102 are positioned slightly below the lowermost end of the upper support member and are formed generally on a radius of curvature having a center corresponding with the axis 37 of the pivot pin 34. Accordingly, regardless of the mounting position of the tumbler assembly 88 along the length of the track 98, the tumbler 72 is positioned in close association with the locking pin 70 depending from the upper support member 36. Importantly, the tumbler includes a plurality of longitudinally extending channels 107, 108, 109, and 110 formed in its outer surface and having different lengths, wherein one of said channels is oriented for reception of the locking pin 70. The relative position of the tumbler assembly along the mounting track 98 thus controls the angular relationship between the lower and upper support members 26 and 36, with the tumbler 72 being rotatable to orient a selected channel 107–110 for reception of the locking pin to control the permitted range of angular deviation between the two support members.

More particularly, once the tumbler assembly 88 is appropriately secured to the track 98 by tightening the screws 100, the tumbler 72 is rotated about its own axis to orient one of the channels 107–110 in a generally upwardly open position for receiving the locking pin 70. In the illustrated embodiment by way of example, the channel 107 is presented for receiving the locking pin wherein this channel 107 has a longitudinal dimension, as viewed in FIG. 7, of sufficient length to permit a relatively small range of rotational movement of the upper support member 36 with respect to the lower support member 26. This permitted rotational motion is highly advantageous in that it accommodates a corresponding range of natural leg flexion for substantially reduced muscle fatigue while skiing. Moreover, the allowed leg flexion permits a significant amount of shock absorption and dissipation by the legs to enhance further the control over movements of the skis. However, as required for most skiers, excessive leg flexion is avoided when the locking pin reaches either longitudinal limit of the channel 107 to prevent loss of ski control, particularly as a result of the relatively high degree of foot and ankle flexion permitted by the use of flexible boots.

If additional rotational freedom is desired by a particular skier or required by the particular skiing conditions, the tumbler 72 is quickly and easily rotated to move the channel 108 into a position for receiving the locking pin 70. This latter channel 108, as viewed in FIG. 8, has a relatively longer length to permit a greater range of rotational freedom and leg flexion than that allowed by the channel 107. Alternatively, if complete rotational freedom is desired, the channel 109, extending fully from one end of the tumbler to the other, can be oriented to receive the locking pin, whereas the channel 110, having a minimum longitudinal length, can be oriented to receive the locking pin if little or no rotational freedom is desired. Conveniently, the tumbler 72 is formed to have a cross-sectional shape for accommodating the arcuate movement of the locking pin throughout the permitted angular deviation, and a spring clip 112 anchored by the fastening screws 100 releasably engages the channel facing toward the adjustment slot 102 to hold the tumbler in a selected rotational position. Moreover, the upper end of the locking pin 70 is conveniently hooked, as at 113, for easy grasping manually or by use of the basket at the lower end of the ski pole (not shown) to retract the pin from the tumbler.

In use, the apparatus 10 of this invention is quickly and easily adjusted to the desired position in accordance with the particular stance and requirements of the individual skier. That is, the angular position of the upper support member 26 is selected by appropriate mounting of the tumbler assembly 88 along the track 98, and the desired range of rotational freedom for leg flexion is selected by rotation of the tumbler 72. While skiing, the apparatus effectively transfers lateral movements of the leg directly to the laterally outside edge 24 of the ski 12 in bypass relation to the foot and ankle. However, neither the leg nor the foot and ankle are locked against at least some flexion such that problems attendant with muscular fatigue, chilling, and poor circulation are greatly relieved. The permission of at least some natural flexion of these parts of the body allows shocks and bumps encountered while skiing to be absorbed by natural flex movements to reduce significantly the likelihood of injury.

The leg support assembly 22 further helps to reduce likelihood of injury by cooperating with the wrap-around cuff 42 to resist inward twisting of the knee particularly during a turning maneuver. That is, in order to place a ski on its edge for a turning maneuver, many skiers apply a lateral force to the ski by a simultaneous forward and inward twisting motion of the knee. This type of twisting motion undesirably exposes the knee to major injury and is not as effective as lateral movement of the entire leg to place a ski on its edge. With the apparatus of this invention, this forward and twisting motion of the knee applies a force to the cuff 42 in a forward and laterally inward direction, as illustrated by the arrow 114 in FIG. 5. However, the forward motion of the knee also acts about the upper support member 36 through a moment arm defined by the rigid cuff shield 44 to tend to turn the knee in a laterally outward direction, as illustrated by the arrow 116. This laterally outward force effectively counterbalances the inward twisting force to restrain the knee against significant twisting in spite of the technique utilized by the skier.

The apparatus 10 of this invention provides additional advantages and conveniences in normal use. More particularly, the locking pin 70 can be selectively retained in an unlocked position retracted from the tumbler 72 whenever complete rotational freedom of the support members and corresponding complete leg flexion is desired, such as while standing awaiting a run, while riding a lift chair, or while cross-country skiing. To this end, the locking pin 70 is provided near its upper end with a lock tab 115 sized for reception into an upwardly open slot 117 at one side of the bore 74. When engagement between the locking pin and the tumbler is desired, the locking pin 70 is rotated about its own axis to permit the tab 115 to slide into the slot 117 and thereby allow downward movement of the locking pin into the aligned channel in the tumbler, as viewed in FIG. 9. However, when complete rotational freedom is desired, the locking pin 70 is lifted from engagement with the tumbler and rotated about its own axis to move the tab 115 out of alignment with the slot 117, as viewed in FIG. 10. This retains the pin 70 in a position retracted from the tumbler 72 to allow complete rotational freedom of the two support members 26 and 36 with respect to each other. When reengagement of the locking pin is desired, the skier rotates the locking pin to realign the tab 115 with the slot 117 to allow the locking pin to reengage the selected channel in the tumbler 72.

Figure 4:
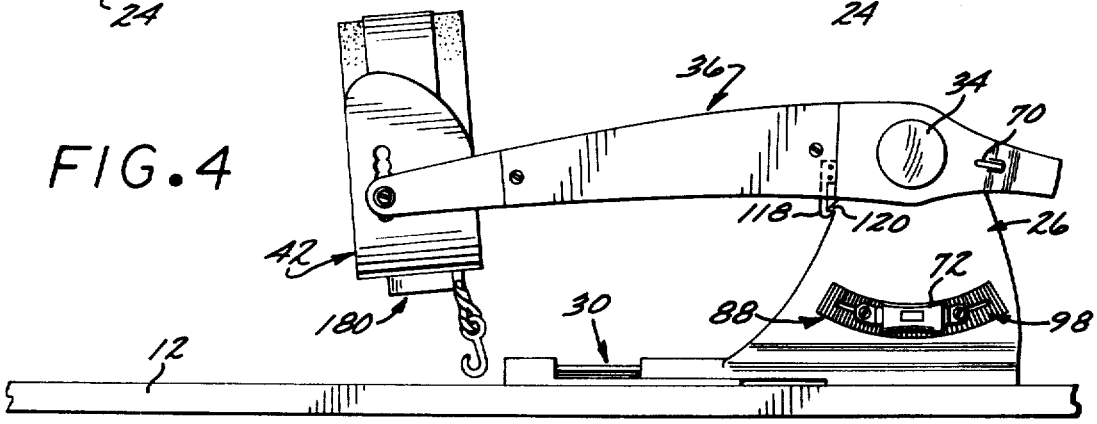
FIG. 4 is a side elevation view generally similar to FIG. 2 and illustrating the ski control apparatus in an alternative position of adjustment.

According to an additional feature of the invention, the upper support member 36 of the leg support assembly 22 defines a convenient carrying handle for the ski when the ski is not in use. For example, as shown in FIG. 4, the upper support member 36 can be moved to a position extending generally parallel with the ski 12. In this position, a springable locking finger 118 on the upper support member 86 engages a mating projection 120 on the lower support member 26 to secure the upper support member 36 in the parallel position. To return the upper support member 36 to the skiing position, it is necessary to rotate the upper support member back toward the upright position, as viewed in FIG. 2, with a force sufficient to disengage the finger 118 from the projection 120.

An alternative embodiment of the invention is illustrated in FIGS. 11–17, wherein components identical to those shown and described in FIGS. 1–10 are referred to by use of common primed reference numerals. As illustrated, the modified apparatus 10′ advantageously incorporates a release binding assembly 122 to preclude any requirement for conventional spring-loaded boot bindings mounted directly on the skis 12′. However, the release binding assembly 122 does not interfere with normal operation of the leg support assembly 22′ which transmits lateral forces directly from the leg to the laterally outside edge 24′ of the ski while simultaneously permitting a selected range of natural leg flexion in the longitudinal direction.

More particularly, the modified apparatus shown in FIGS. 11–17 includes the lower support member 26′ having an upright 32′ carrying the pivot pin 34′ and a modified transversely extending sole plate 124 adapted to be secured with respect to the ski. However, in this embodiment, the sole plate 124 is fastened directly to the ski 12′ as by use of screws 126 (FIG. 12) instead of being shaped for connection to a conventional boot binding as described with respect to the previous embodiment.

The pivot pin 34′ at the top of the lower support member 26′ rotatably supports a modified upper support member 128 which extends upwardly for connection to the skier's leg by use of a wraparound cuff 42′. The upper support member 128 cooperates with the lower support member 26′ to transfer laterally directed forces from the skier's leg directly to the outside edge 24′ of the ski while accommodating leg flexion in the longitudinal direction. Importantly, the permitted range of this longitudinal flexion is selectively set by use of an adjustment assembly 68′ including a locking pin 70′ on the upper support member 128 for reception into one of a plurality of channels formed in a rotatable tumbler 72′ carried by the lower support member 26′, all as described in detail with respect to FIGS. 1–10.

The modified upper support member 128 is formed in sections to provide the release binding assembly 122 wherein the support member sections are adapted to separate from each other in response to excessive forces encountered while skiing. More specifically, the upper support member 128 includes a lower, first section 130 having a generally flattened profile in the vicinity of the pivot pin 34′ and merging upwardly into a tubular cross-sectional shape. This first section 130 is sized for end-to-end abutting relation with an upper, second section 132 having a generally tubular cross-sectional shape which blends upwardly into a generally flatened profile portion attached to the cuff 42′ by the connecting screw 40′. The end-abutting first and second sections 130 and 132 telescopically receive, with a relatively close sliding fit, an intermediate, generally tubular third section 134 which carries a pair of spring-loaded release assemblies 136 and 137 for respective connection to the support member sections 130 and 132 with a spring force of predetermined magnitude.

Figure 15:
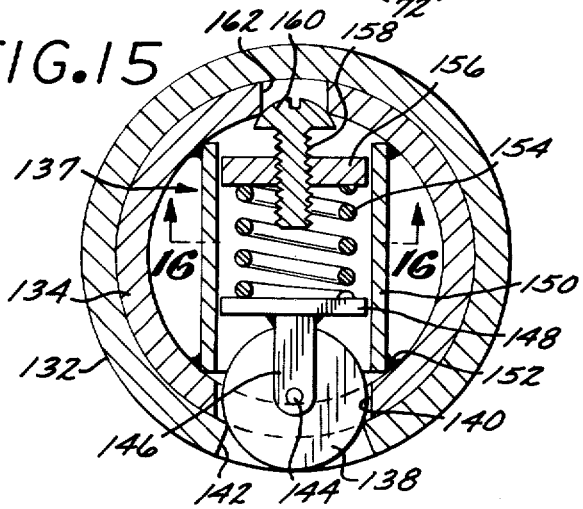
FIG. 15 is a vertical section taken generally on the line 14—14 of FIG. 12.
Figure 16:
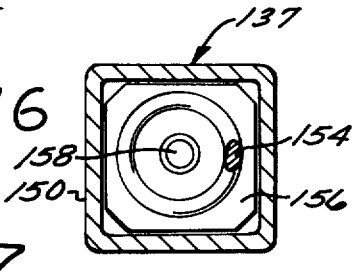
FIG. 16 is a sectional view taken generally on the line 16—16 of FIG. 15.

The spring-loaded release assembly 137 is shown in detail in FIGS. 15 and 16 to include a release wheel 138 biased to project outwardly through an aligned pair of generally horizontal slots 140 and 142 in the intermediate section 134 and the second section 132. More particularly, the release wheel 138 is rotatably supported by an elongated shaft pin 144 secured to a pair of support arms 146 which are in turn carried by a baseplate 148. The baseplate 148 is carried within a generally rectangular hollow housing 150 secured within the intermediate section 134 as by welds 152 to extend generally in a transverse direction thereby accommodating generally radial displacement of the baseplate 148 and the release wheel 138.

The release wheel 138 is urged by a compression spring 154 to project at least partially through the slot 140 in the intermediate section and further through the associated slot 142 in the second section 132 when the slot 142 is aligned therewith. This compression spring 154 is contained within the support housing 150 and reacts between the baseplate 148 and a backplate 156 at the opposite end of the housing. Importantly, this backplate 156 has a cross-sectional shape to prevent rotation thereof within the support housing 150 and threadably carries an adjustment screw 158 having its head 160 seated partially into a screwdriver access hole 162 formed in the intermediate section 134 at a location generally opposite the release wheel 138. Accordingly, the backplate 156 is adjustably positioned toward and away from the baseplate 148 by rotation of the adjustment screw 158 to vary the spring force applied to the release wheel 138.

In use, when the release wheel 138 is received into the slot 142 in the second tubular section 132, the compression spring 154 applies a selected and predetermined spring force acting generally in the plane of the release wheel to hold the components together. When forces encountered during skiing acting generally in the plane of the release wheel 138 exceed this predetermined spring force, such as excessive twisting forces acting on the leg and the leg support assembly 22′, the release wheel 138 retracts from the slot 142 in the second section 132 to permit separation of the second and third tubular sections 132 and 134.

Figure 17:
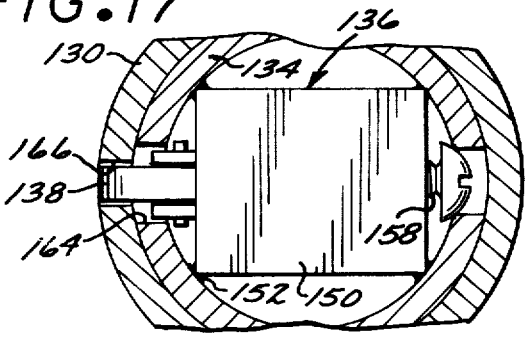
FIG. 17 is a sectional view taken generally on the line 17—17 of FIG. 15.

The other release assembly 136 is shown in FIG. 17 and provides a spring-loaded connection between the third section 134 and the first section 130. This latter release assembly is identical to the above-described release assembly 137, except that the entire assembly 136 is rotated 90 degrees about a transverse axis to orient a release wheel 138 in a generally vertical plane for spring-biased reception into generally vertical aligned slots 164 and 166 formed respectively in the third section 134 and the first section 130. Thus, the release assembly 136 prevents separation of the third and first sections 134 and 130 of the leg support assembly 22', unless vertically oriented forces exceed a predetermined magnitude in accordance with the adjustment of the associated adjustment screw 158.

Figure 11:
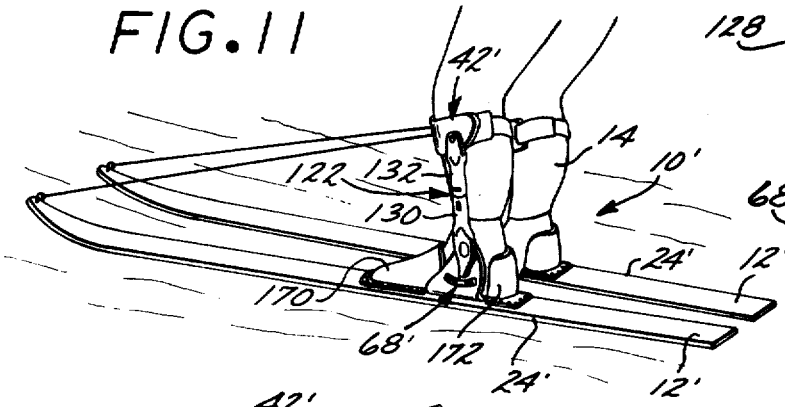
FIG. 11 is a perspective view illustrating an alternative embodiment of the invention.
Figure 12:
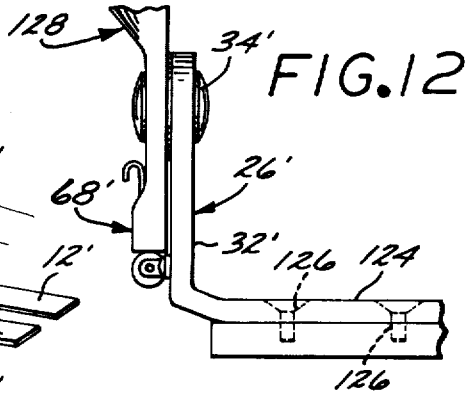
FIG. 12 is an enlarged fragmented rear elevation view of a portion of the embodiment of FIG. 11.
Figure 13:
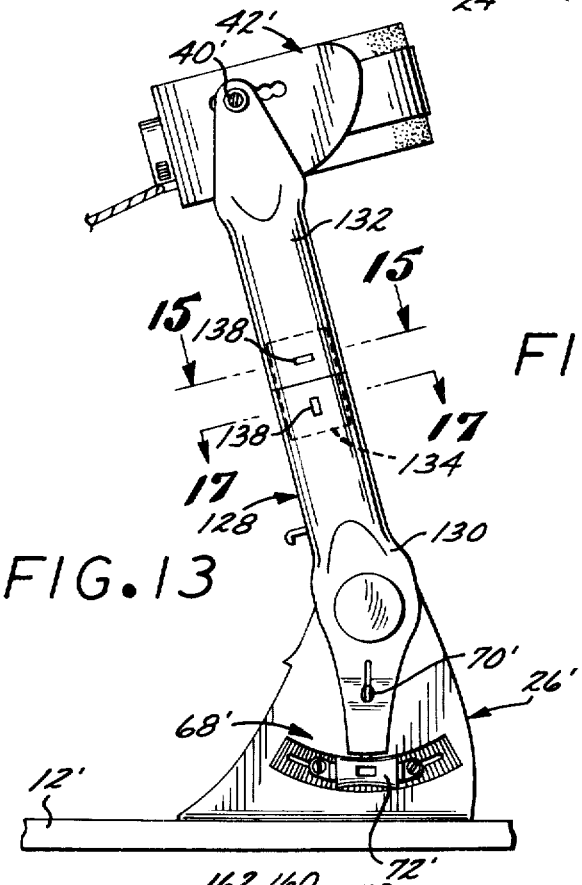
FIG. 13 is an enlarged side elevation view of the embodiment of FIG. 11.
Figure 14:
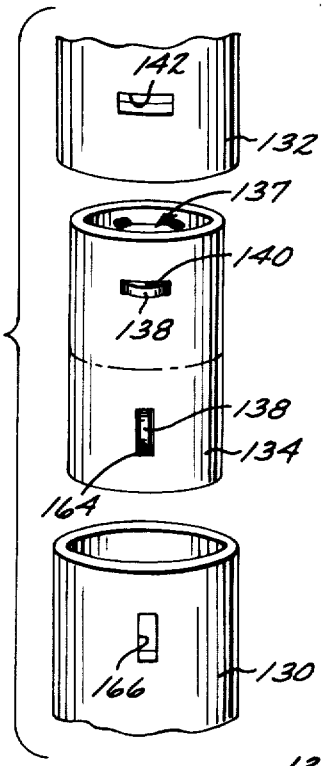
FIG. 14 is an enlarged exploded perspective view illustrating a portion of the embodiment of FIG. 11

The above-described binding assemmbly 122 advantageously permits the use of relatively simple and inexpensive devices for holding the skier's boot 20 on the ski 12' in lieu of the conventional and expensive spring-loaded boot binding. For example, as illustrated in FIG. 11, the skier's foot can be held in place within a rearwardly open toe strap 170 mounted on the ski 12' for receiving the front portion of the skier's boot 20 and for securing the boot against lateral and forward motion. The strap 170 is desirably associated with a rear heel cup 172 which secures the boot against rearward motion and which can be adapted to adjustable longitudinal movement to accommodate different boot sizes. Moreover, if desired, the toe strap 170 and the heel cup 172 can be combined with a textured rough surface (not shown) on the ski 12' to enhance gripping engagement between the boot and the ski.

In use, the skier's boots 20 are prevented from inadvertently slipping off the skis 12' by the relatively small retention forces provided by the toe straps 170 and the heel cups 172. These forces are sufficient during normal skiing maneuvers since the substantial lateral forces required for turning are transmitted from the legs 14' directly to the skis 12' via the leg support assembly 22' and not via the foot and ankle. However, if excessive forces are encountered, the leg support assembly 22' separates by operation of the springloaded release assemblies 136 and 137 whereupon the boots 20 are dislodged from the toe straps 170 in response to relatively small forces. Accordingly, the apparatus 10' provides the desired control of the skis with a simple and inexpensive boot binding structure while at the same time providing protection against injury when excessive forces are encountered.

Figure 2:
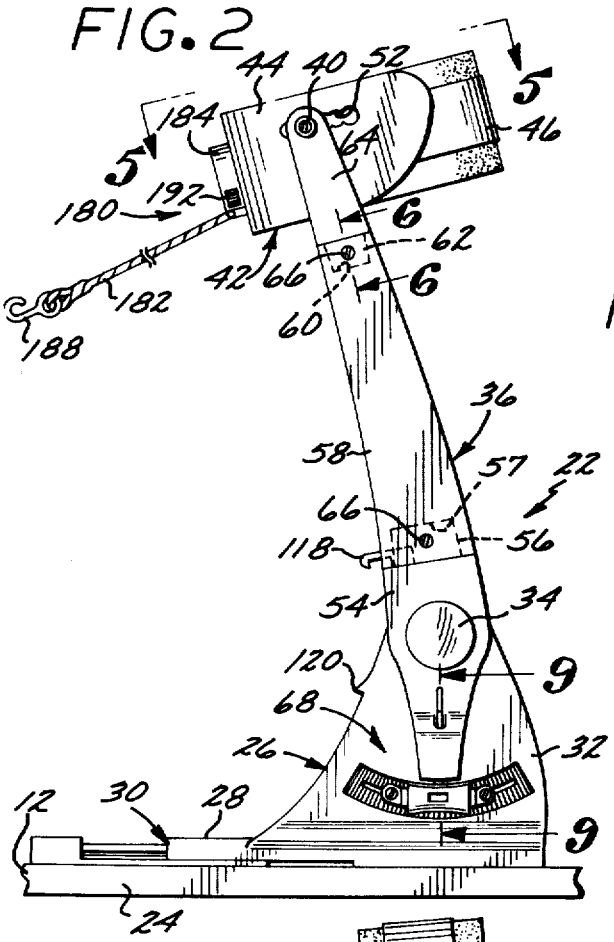
FIG. 2 is an enlarged side elevation view of the ski control apparatus.
Figure 3:
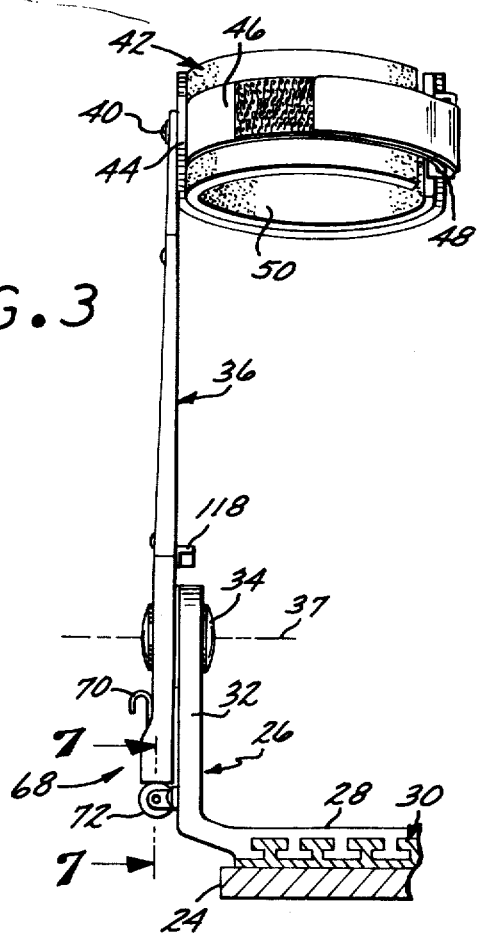
FIG. 3 is a rear elevation view of the ski control apparatus.

As shown in FIGS. 1 and 2, additional features may be provided for use with the present invention to obtain a reverse camber condition of the skis during selected skiing conditions, such as when skiing in relatively deep powder. More particularly, the skis 12 are normally manufactured to include a longitudinally arched construction for optimum performance while skiing. During a normmal turning maneuver on typically packed snow, the skier inncreases the downward force applied to the front of the skis to reduce or eliminate the natural camber of skis and thereby alter the shape of the skis to a so-called reverse camber condition with increased surface area contact with the snow for improved control. However, when skiing in deep powdered snow, this increase in downward force tends to bury the front tips of the skis in the snow, resulting in an undesired loss of control instead of increased control.

In accordance with the invention, a cable assembly 180 is mounted on the front of the wraparound cuff 42 and is selectively operated to provide an alternative method of achieving a reverse camber ski condition. This cable assembly 180 comprises a flexible cable 182 normally retracted into a relatively compact cable housing 184 mounted on the cuff 42 by means of a conventional spring-actuated windup assembly (not shown). When use is desired, the cable 182 is withdrawn from the housing 184 and is connected to the front tip 186 of the ski 12 in an appropriate manner, such as by use of a hook 188 on the cable for reception through an eye bolt 190 on the ski. Importantly, the withdrawn length of the cable is chosen such that the cable is relatively taut when the skier assumes a stance generally corresponding with the maximum degree of leg flexion permitted by the adustable leg support assembly 22. A locking mechanism 192 of a conventional design and of the type typically provided with spring-loaded windup assemblies is manually operated to lock the cable against further withdrawing from the housing.

In use, when a reverse camber condition is desired, the skier modifies his stance to a slightly more erect position. This moves the knees and the cuff 42 in a rearward direction within the limited flexion range permitted by the leg support assembly to pull upwardly and rearwardly on the cable 182. Such pulling action lifts upwardly on the front tip 186 of the ski to reduce or eliminate the natural camber and thereby achieve a reverse camber condition. Importantly, this reverse camber condition is achieved without increasing downward force on the front tip of the ski whereby the cable assembly 180 is uniquely desirable for use while skiing in deep powder.

A variety of further modifications and improvements to the apparatus described herein are believed to be apparent to one skilled in the art. Accordingly, no limitation on the invention is intended, except by way of the appended claims.

What is claimed is:

1. Apparatus for connection between a snow ski and the leg of a skier at a position below the skier's knee for improving control of the snow ski, comprising:

a leg support assembly having a lower support member for connection to the ski to project generally upwardly from the laterally outside edge thereof, and an elongated upper support member mounted on said lower support member for rotation about an axis extending generally transversely with respect to the ski, said upper and lower support members being substantially rigid in a transverse direction with respect to the ski;

means for connecting said upper support member to the skier's leg at a position slightly below the knee, whereby said upper and lower support members transfer lateral leg movements directly to the ski and rotate relative to one another to accommodate natural leg flexion in a longitudinal direction with respect to the ski, said connecting means including a wraparound cuff having a generally U-shaped rigid shield connected to said upper support member generally at the laterally outside face of the skier's leg and shaped to extend therefrom with a first portion extending generally forwardly from said upper support member and joined to a second portion extending generally laterally and inwardly relative to said first portion in a direction for passage in front of the skier's leg, said second portion being joined in turn to a third portion extending generally rearwardly therefrom generally at the laterally inside face of the skier's leg, and strap means for securing the skier's leg into said shield betweenn said first and third shield portions and in bearing engagement with said second shield portion; and means for permitting a predetermined limited range of relative rotational movement between said upper and lower support members to permit forward and rearward movement of said upper support member in a longitudinal direction relative to the ski respectively between forward and rearward limit positions to correspondingly permit a limited range of substantially unrestrained leg flexion, said upper support member having a structural rigidity to substantially prevent forward bending thereof in a longitudinal direction with respect to the ski when said upper support member is in said forward limit position;

said shield being rotatable in a twisting motion generally forwardly and laterally outwardly about a longitudinal axis of said upper support member in response to forward movement of the skier's leg in bearing engagement with said shield portion when said upper support member is in said forward limit position to carry the skier's leg in a forward and laterally outward direction relative to said upper support member and thereby resist laterally inward movement of and accompanying lateral inward twisting of the skier's leg.

2. The apparatus of claim 1 wherein said upper support member is pivotally connected to said lower support member for rotation about an axis extending generally transversely with respect to the ski and positioned generally in axial alignment with the skier's ankle.

3. The apparatus of claim 1 wherein said upper support member comprises a plurality of interfitting sections sized to project upwardly from said lower support member and to terminate at a position at least slightly below the skier's knee.

4. The apparatus of claim 1 wherein said means for permitting a predetermined limited range of rotational movement between said upper and lower support members includes means for selectively adjusting the range of permitted relative rotational movement.

5. The apparatus of claim 1 wherein said means for permitting a predetermined limited range of rotational movement between said upper and lower support members includes means for selectively adjusting the angular relationship between said upper and lower support members.

6. The apparatus of claim 1 wherein said means for permitting a predetermined limited range of rotational movement between said upper and lower support members comprises an adjustment assembly for adjustably selecting the angular relationship between said upper and lower support members and for adjustably selecting the permitted range of angular deviation from said selected angular relationship.

7. The apparatus of claim 1 wherein said leg support assembly includes a releasable binding assembly responsive to forces encountered while skiing in excess of a predetermined magnitude for separation of said leg support assembly.

8. The apparatus of claim 7 wherein said releasable binding assembly is responsive to forces acting in at least two directions.

9. The apparatus of claim 7 wherein said upper support member includes at least two separable sections, said releasable binding assembly being responsive to forces encountered while skiing in excess of a predetermined magnitude for separation of said separable sections.

10. The apparatus of claim 1 further including a cable for releasable connection between said cuff and the ski near the front tip thereof, and means for securing the cable in a relatively taut condition when said upper support member is rotated generally to said forward limit position within the range of permitted rotational movement, whereby movement of said upper support member in a rearward rotational direction correspondingly moves said cuff in the same direction such that said cable pulls upwardly and rearwardly on the front tip of the ski to alter the camber of the ski.

11. Apparatus for connection between a snow ski and the leg of a skier at a position below the skier's knee for improving control of the snow ski, comprising:

a leg support assembly for connection to the ski said leg support assembly including an elongated support member and means for mounting one end of said support member to the ski in a position with said support member extending generally upwardly from the laterally outside edge of the ski, said support member being substantially rigid in a transverse direction with respect to the ski and pivotally movable in a longitudinal direction with respect to the ski;

means for connecting said support member to the skier's leg at a position slightly below the knee whereby said leg support assembly transfers lateral leg movements directly to the ski and accommodates natural leg flexion in the longitudinal direction with respect to the ski, said connecting means comprising a wraparound cuff for wrapping securely about the skier's leg, said cuff including a generally U-shaped rigid shield connected to said leg support assembly generally at the laterally outside face of the skier's leg and shaped to extend therefrom with a first portion extending generally forwardly from said support member and joined to a second portion extending generally laterally and inwardly relative to said first portion in a direction for passage in front of the skier's leg, said second portion being joined in turn to a third portion extending generally rearwardly therefrom generally at the laterally inside face of the skier's leg, and strap means for securing the skier's leg into said shield between said first and third shield portions and in bearing engagement with said second shield portion; and means for adjustably selecting the angular position of said support member with respect to the ski and for adjustably permitting a selected predetermined limited range of pivotal movement of said support member in deviation from said selected angular position and between forward and rearward limit positions to permit a limited range of substantially unrestrained leg flexion, said support member having a structural rigidity to substantially prevent forward bending thereof in a longitudinal direction with respect to the ski when said support member is in said forward limit position;

said shield being rotatable in a twisting motion generally forwardly and laterally outwardly about a longitudinal axis of said upper support member in response to forward movement of the skier's leg in bearing engagement with said shield portion when said support member is in said forward limit position to carry the skier's leg in a forward and laterally outward direction relative to said support member and thereby resist laterally inward movement of and accompanying lateral inward twisting of the skier's leg.

12. The apparatus of claim 11 wherein said leg support assembly comprises a lower support member for connection to the ski to project generally upwardly from the laterally outside edge thereof, and an upper support member mounted for rotation with respect to said lower support member about an axis extending generally transversely with respect to the ski and positioned generally for alignment with the skier's ankle, said connecting means being mounted generally at the upper end of said upper support member.

13. The apparatus of claim 12 wherein said upper support member comprises a plurality of interfitting sections sized to project upwardly from said lower support member and to terminate at a position at least slightly below the skier's knee.

14. The apparatus of claim 12 wherein said upper support member is rotatably movable with respect to said lower support member to a position substantially in parallel with the ski, and including releasable locking means for securing said upper support member in said substantially parallel position.

15. The apparatus of claim 12 wherein said leg support assembly includes a releasable binding assembly responsive to forces encountered while skiing in excess of a predetermined magnitude for separation of said leg support assembly.

16. The apparatus of claim 15 wherein said upper support member includes at least two separable sections, said releasable binding assembly being responsive to forces encountered while skiing in excess of a predetermined magnitude for separation of said separable sections.

17. The apparatus of claim 12 further including a cable for releasable connection between said cuff and the ski near the front tip thereof, and means for securing the cable in a relatively taut condition when said upper support member is rotated to a generally forward position within the range of permitted rotational movement, whereby movement of said upper support member in a rearward rotational direction correspondingly moves said cuff in the same direction such that said cable pulls upwardly and rearwardly on the front tip of the ski to alter the camber of the ski.

18. Apparatus for connection between a snow ski and the leg of a skier at a position below the skier's knee for improving control of the snow ski, comprising:

a leg support assembly including a lower support member for connection to the ski and extending generally upwardly from the laterally outside edge of the ski, and an upper support member mounted for rotation with respect to said lower support member about an axis generally transverse with respect to the ski and positioned generally for alignment with the skier's ankle, said leg support assembly being substantially rigid in a transverse direction with respect to the ski and pivotally movable in a longitudinal direction with respect to the ski;

means generally at the upper end of said upper support member for connecting said leg support assembly to the skier's leg at a position at least slightly below the knee whereby said leg support assembly transfers lateral leg movements directly to the ski and accommodates natural leg flexion in the longitudinal direction; and means for adjustably selecting the angular position of said leg support assembly with respect to the ski and for adjustably permitting a selected range of pivotal movement of said leg support assembly in deviation from said selected angular position, said adjustment means comprising a track formed on said lower support member, a tumbler assembly adapted for connection in one of a plurality of positions along said track and including a rotatable tumbler having a plurality of elongated channels of different length formed therein, and a locking pin movably carried by said upper support member for reception into a selected one of the channels formed in said tumbler, whereby the angular relationship of said upper support member with respect to said lower support member and the ski is adjustably selected by positioning of said tumbler assembly along said track and the range of permitted angular movement between said upper and lower support members is adjustably selected by rotation of said tumbler for reception of said locking pin in a selected one of said channels.

19. The apparatus of claim 18 including means for biasing said locking pin into normal engagement with a selected one of the channels in said tumbler.

20. The apparatus of claim 19 including means for selectively retaining said locking pin in a retracted position withdrawn from said tumbler.

21. The apparatus of claim 19 wherein said locking pin includes a hooked upper end disposed for easy grasping to retract said pin from said tumbler against the force applied by said biasing means.

22. The apparatus to claim 18 wherein at least one of said channels is longitudinally open to permit unrestricted rotational movement between said upper and lower support members when said locking pin is received therein, at least one of said channels has a longitudinal length to substantially prevent rotational movement between said upper and lower support members when said locking pin is received therein, and at least one of said channels has a longitudinal dimension sufficient to permit rotational movement of limited range between said upper and lower support members when said locking pin is received therein.

23. Apparatus for connection between a snow ski and the leg of a skier at a position below the skier's knee for improving control of the snow ski, comprising:

a leg support assembly for connection to the ski, said leg support assembly including an elongated support member and means for mounting one end of said support member to the ski in a position with said support member extending generally upwardly from the laterally outside edge of the ski, said support member being substantially rigid in a transverse direction with respect to the ski and said mounting means including means for preventing movement of said support member in a forward longitudinal direction with respect to the ski beyond a predetermined forward limit position, said support member having a structural rigidity to substantially prevent forward bending thereof in a longitudinal direction with respect to the ski when said support member is in said forward limit position; and a wraparound cuff mounted generally at the upper end of said support member for connecting said leg support assembly to the skier's leg at a position slightly below the knee, said cuff including a substantially rigid and generally U-shaped shield member shaped to extend from said support member at the laterally outside face of the skier's leg with a first portion extending generally forwardly from said support member and joined to a second portion extending generally laterally and inwardly relative to said first portion in a direction for passage in front of the skier's leg, said second portion being joined in turn to a third portion extending generally rearwardly therefrom at the laterally inside face of the skier's leg, said cuff further including means for securing the skier's leg generally between said first and third shield member portions and in bearing engagement with said second shield member portion, said shield member being rotatable in a twisting motion generally forwardly and laterally outwardly about a longitudinal axis of said support member in response to forward movement of the skier's leg in bearing engagement with said second shield portion when said support member is in said forward limit position to carry the skier's leg in a forward and laterally outward direction relative to said support member and thereby resist laterally inward movement and accompanying laterally inward twisting of the skier's knee.

24. The apparatus of claim 23 wherein said leg support assembly is pivotally movable in a longitudinal direction with respect to the ski, said movement preventing means including means for adjustably selecting the angular position of said leg support assembly with respect to the ski and for adjustably permitting a selected range of pivotal movement of said leg support assembly in deviation from said selected angular position.

25. The apparatus of claim 24 further including a cable for releasable connection between said cuff and the ski near the front tip thereof, and means for securing the cable in a relatively taut condition when said leg support assembly is rotated to a generally forward position within the range of permitted rotational movement, whereby movement of said leg support assembly in a rearward rotational direction correspondingly moves said cuff in the same direction such that said cable pulls upwardly and rearwardly on the front tip of the ski to alter the camber of the ski.

26. The apparatus of claim 23 wherein said leg support assembly includes a releasable binding assembly responsive to forces encountered while skiing in excess of a predetermined magnitude for separation of said leg support assembly.

27. Apparatus for connection between a snow ski and the leg of a skier at a position below the skier's knee for improving control of the snow ski, comprising:

a leg support assembly for connection to the ski and extending generally upwardly from the laterally outside edge of the ski, said leg support assembly being substantially rigid in a transverse direction with respect to the ski and pivotally movable in a longitudinal direction with respect to the ski, said leg support assembly being formed from at least two separable sections;

means for connecting said leg support assembly to the skier's leg at a position at least slightly below the knee whereby said leg support assembly transfers lateral leg movements directly to the ski and accommodates natural leg flexion in the longitudinal direction; and a releasable binding assembly for releasably connecting said separable sections of said leg support assembly with respect to each other, said releasable binding assembly being responsive to forces encountered while skiing in excess of a predetermined magnitude for separation of said separable sections;

said separable sections of said leg support assembly comprising a pair of generally tubular sections for end-to-end abutting relation, at least one of said tubular sections having an elongated slot formed therein, and wherein said releasable binding assembly comprises a binding member sized for telescopic reception into said pair of tubular sections and having a spring-biased release member movably mounted therein for projection of a portion thereof through a slot formed in said binding member and further into the slot formed in said one tubular section, said release member being retractable from the slot in said one tubular section in response to a force acting thereon in excess of a predetermined magnitude to permit separation of said one tubular section with respect to said binding member.

28. The apparatus of claim 27 including means for adjustably selecting the angular position of said leg support assembly with respect to the ski and for adjustably permitting a selected range of pivotal movement of said leg support assembly in deviation from said selected angular position.

29. The apparatus of claim 27 wherein said releasable binding assembly is responsive to forces acting in at least two directions.

30. The apparatus of claim 27 wherein said connecting means comprises a wraparound cuff generally at the upper end of said leg support assembly for connecting said leg support assembly to the skier's leg at a position at least slightly below the knee, said cuff including a substantially rigid member shaped to extend from said leg support assembly at the laterally outside face of the skier's leg to a position in front of the skier's leg whereby said rigid member provides a moment arm for rotation about said leg support assembly in response to forward movement of the skier's leg to carry said cuff in a forward and laterally outward direction relative to said leg support assembly and thereby resist laterally inward twisting of the skier's knee.

31. The apparatus of claim 30 further including a cable for releasable connection between said cuff and the ski near the front tip thereof, and means for securing the cable in a relatively taut condition when said leg support assembly is rotated to a generally forward position within the range of permitted rotational movement, whereby movement of said leg support assembly in a rearward rotational direction correspondingly moves said cuff in the same direction such that said cable pulls upwardly and rearwardly on the front tip of the ski to alter the camber of the ski.

32. The apparatus of claim 27 including adjustable spring means for biasing said release member with a spring force of selected magnitude.

33. The apparatus of claim 27 wherein the skier has a foot, said apparatus including means mounted on the ski for reception of the skier's foot to retain the skier's foot on the ski.

34. Apparatus for connection between a snow ski and the leg of a skier at a position below the skier's knee for improving control of the snow ski, comprising:

a leg support assembly for connection to the ski and extending generally upwardly from the laterally outside edge of the ski, said leg support assembly being substantially rigid in a transverse direction with respect to the ski and pivotally movable in a longitudinal direction with respect to the ski;

means for connecting said leg support assembly to the skier's leg at a position at least slightly below the knee whereby said leg support assembly transfers lateral leg movements directly to the ski and accommodates natural leg flexion in the longitudinal direction;

means for adjustably selecting the angular position of said leg support assembly with respect to the ski and for adjustably permitting a selected range of pivotal movement of said leg support assembly in deviation from said selected angular position; and cable means for releasable connection between said connecting means and the ski near the front tip thereof in a relatively taut condition when said leg support assembly is rotated to a generally forward position within the range of permitted rotational movement, whereby movement of said leg support assembly in a rearward rotational direction correspondingly moves said connecting means to pull upwardly and rearwardly on said cable means to pull upwardly on the front tip of the ski and thereby alter the camber of the ski, said cable means comprising a cable housing carried by said connecting means, a cable retractable into said housing and having means thereon adapted for connection to the ski near the front tip thereof when said cable is withdrawn from said housing, and lock means for releasably locking said cable against further withdrawal from said housing.

35. The apparatus of claim 34 wherein said leg support assembly includes a releasably binding assembly responsive to forces encountered while skiing in excess of a predetermined magnitude for separation of said leg support assembly.

36. The apparatus of claim 34 wherein said connecting means comprises a wraparound cuff for wrapping securely about the skier's leg, said cuff including a generally rigid shield connected to said leg support assembly generally at the laterally outside face of the skier's leg and shaped to extend therefrom in front of the skier's leg to a position generally at the laterally inside face of the skier's leg, and strap means for securing the skier's leg into said shield in bearing engagement therewith, said shield tending to rotate slightly about said leg support assembly in response to forward movement of the skier's leg to resist laterally inward twisting of the skier's knee.

* * * * *